US005979893A

United States Patent [19]

Mou et al.

[11] Patent Number: 5,979,893

[45] Date of Patent: Nov. 9, 1999

[54] PAPER GUIDE MECHANISM FOR PRINTER

[75] Inventors: Tse-Chi Mou; Lin Nien Chin, both of Taipei Hsien, Taiwan

[73] Assignee: Dbtel Incorporated, Tu-Cheng, Taiwan

[21] Appl. No.: 09/003,791

[22] Filed: Jan. 7, 1998

[51] Int. Cl.[6] ..... B65H 5/02

[52] U.S. Cl. ..... 271/273; 271/274

[58] Field of Search ..... 271/273, 274

[56] References Cited

U.S. PATENT DOCUMENTS 4,997,179 3/1991 Mizutani et al. ..... 271/306

5,580,042 12/1996 Taniguro et al. ..... 271/274

*Primary Examiner*—William E. Terrell

*Assistant Examiner*—Kenneth W. Bower

*Attorney, Agent, or Firm*—Madson & Metcalf

[57] ABSTRACT

A paper guide mechanism for guiding a movement of a paper in a printer includes a frame body having a lower roller and mounted in the printer, and a paper guide having an upper roller cooperating with the lower roller for guiding therebetween the paper, in which the upper roller is parallelly displaced with respect to the lower roller for biasing the paper in order that the paper can be guided through the paper guide smoothly. The paper guide further has an elastic rod being integrally formed with the paper guide and the elastic rod includes a retaining part to rotatably retain a shaft of the upper roller. The retaining part can have a retaining channel having an opening through which the shaft of the upper roller is received in the channel.

10 Claims, 4 Drawing Sheets

PAPER GUIDE MECHANISM FOR PRINTER

FIELD OF THE INVENTION

The present invention relates to a paper guide mechanism and more particularly to an improved paper guide assembly for a movement of a paper in a printer.

BACKGROUND OF THE INVENTION

So far the design of the elastic plate of the paper guide in the printer is popularly seen and used to press the paper as it is moved between the feeding roller and the following roller to be printed. Referring now to FIG. 1, there is shown a prior paper guide assembly including a paper guide 10 and two metal elastic plates 11 separable from paper guide 10. Although the paper can be guided along a specific direction by the combination of the paper guide 10 and the elastic plates 11 with a frame body, it is necessary to mount eight slender strips 13 at both sides of each following roller 12 to suppress the vibration of the paper. It is troublesome, time-consuming and expensive to assemble the separable elastic plates 11 with the paper guide 10.

It is therefore tried by the applicant to deal with the above situation encountered by the prior art.

SUMMARY OF THE INVENTION

It is therefore an object of the present invention to promote the manufacturing efficiency by an integrally formed paper guide structure.

It is further an object of the present invention to provide a practical and effective design for pressing a print paper.

It is additional an object of the present invention to simplify the structure of the paper guide.

According to the present invention, a paper guide mechanism for guiding a movement of a paper in a printer includes a frame body having a lower roller and mounted in the printer, and a paper guide having an upper roller cooperating with the lower roller for guiding therebetween the paper, in which the upper roller is parallelly displaced with respect to the lower roller for biasing the paper in order that the paper can be guided through the paper guide smoothly.

Preferably the paper guide further has an elastic rod being integrally formed with the paper guide.

Preferably the elastic rod includes a retaining part to rotatably retain a shaft of the upper roller.

Certainly the retaining part can have a retaining channel having an opening through which the shaft of the upper roller is received in the channel.

Certainly the channel can be substantially cylindrical in which the shaft of the roller is coaxially mounted.

Preferably the elastic rod is approximately perpendicular to a vertical part of the paper guide.

Preferably the elastic rod retains one end of the upper roller.

Certainly the paper guide can further include a second elastic rod for retaining the other end of the upper roller.

Certainly the paper guide can further include a second upper roller and a third upper roller through which the paper is guided smoothly.

Preferably the paper guide is screwed to the frame body.

Preferably the upper roller is a following roller and the lower roller is a feeding roller.

Of course the elastic rod can have a higher elasticity as the depth of the paper is thicker. The upper roller and the lower roller cooperatively guide the movement of the paper along a specific direction at a pressed position. The pressed position would be higher as the thickness of the paper is thicker and the specific derection is the direction outputting the paper having been printed. The paper's height would be lower as it is guided by the upper roller and the lower roller.

The present invention may best be understood through the following descriptions with reference to the accompanying drawings, in which:

DETAILED DESCRIPTION OF THE PREFERRED EMBODIMENTS

Figure 1:
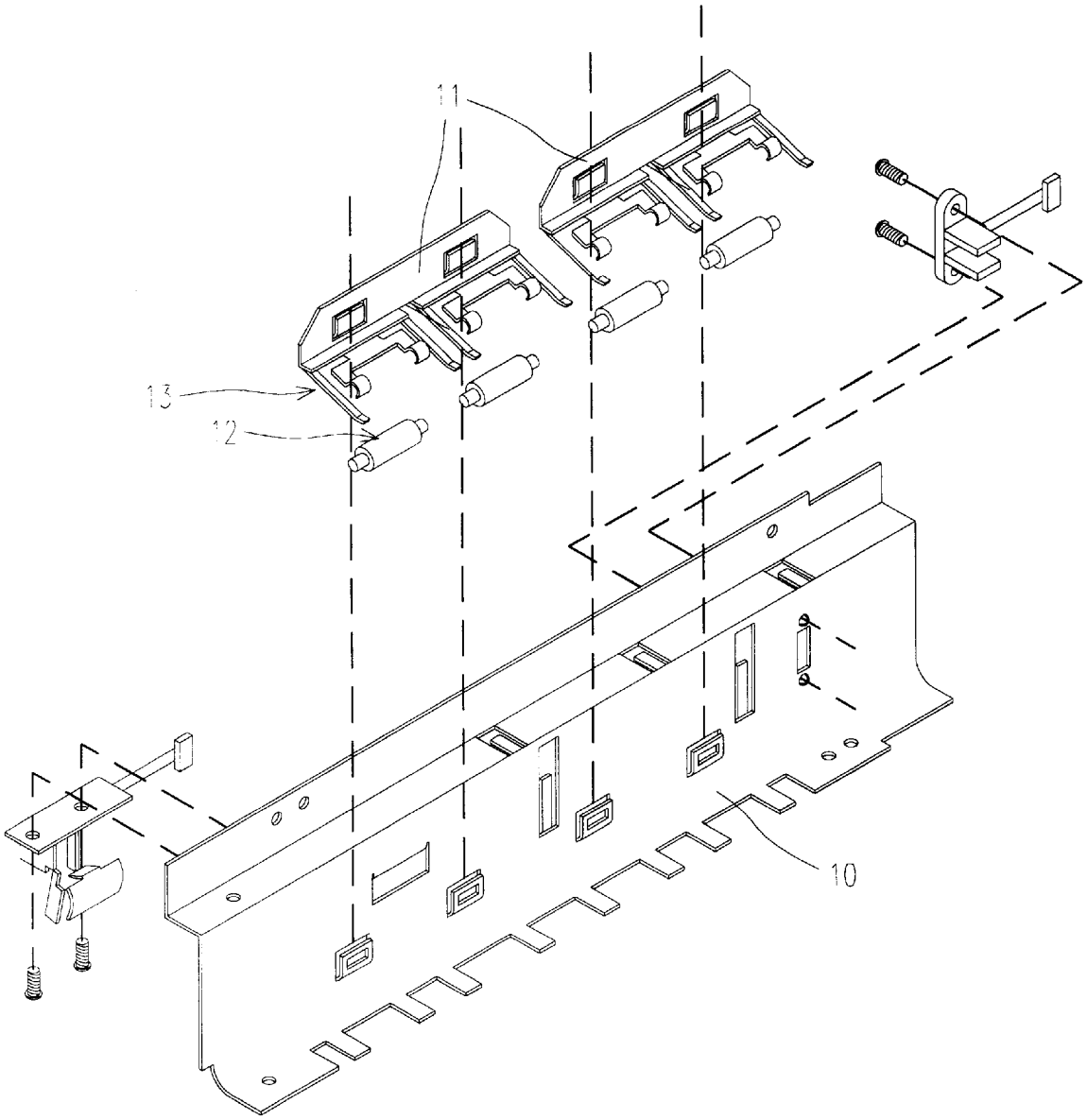
Fig. 1 (PRIOR ART)
FIG. 1 is an exploded perspective view of a prior art paper guide assembly.
Figure 2:
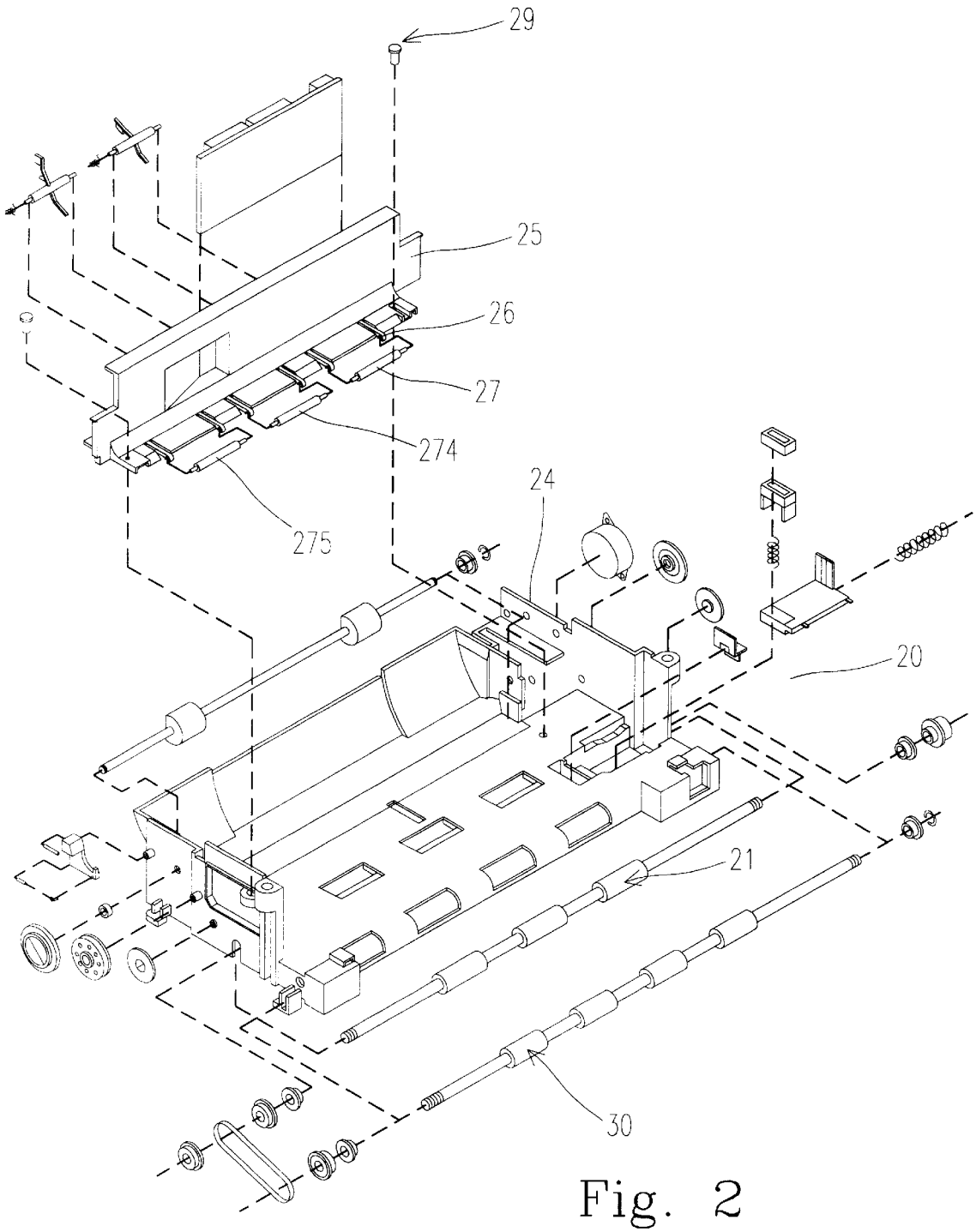
FIG. 2 is an exploded perspective view of a preferred embodiment of a paper guide mechanism according to the invention.
Figure 3:
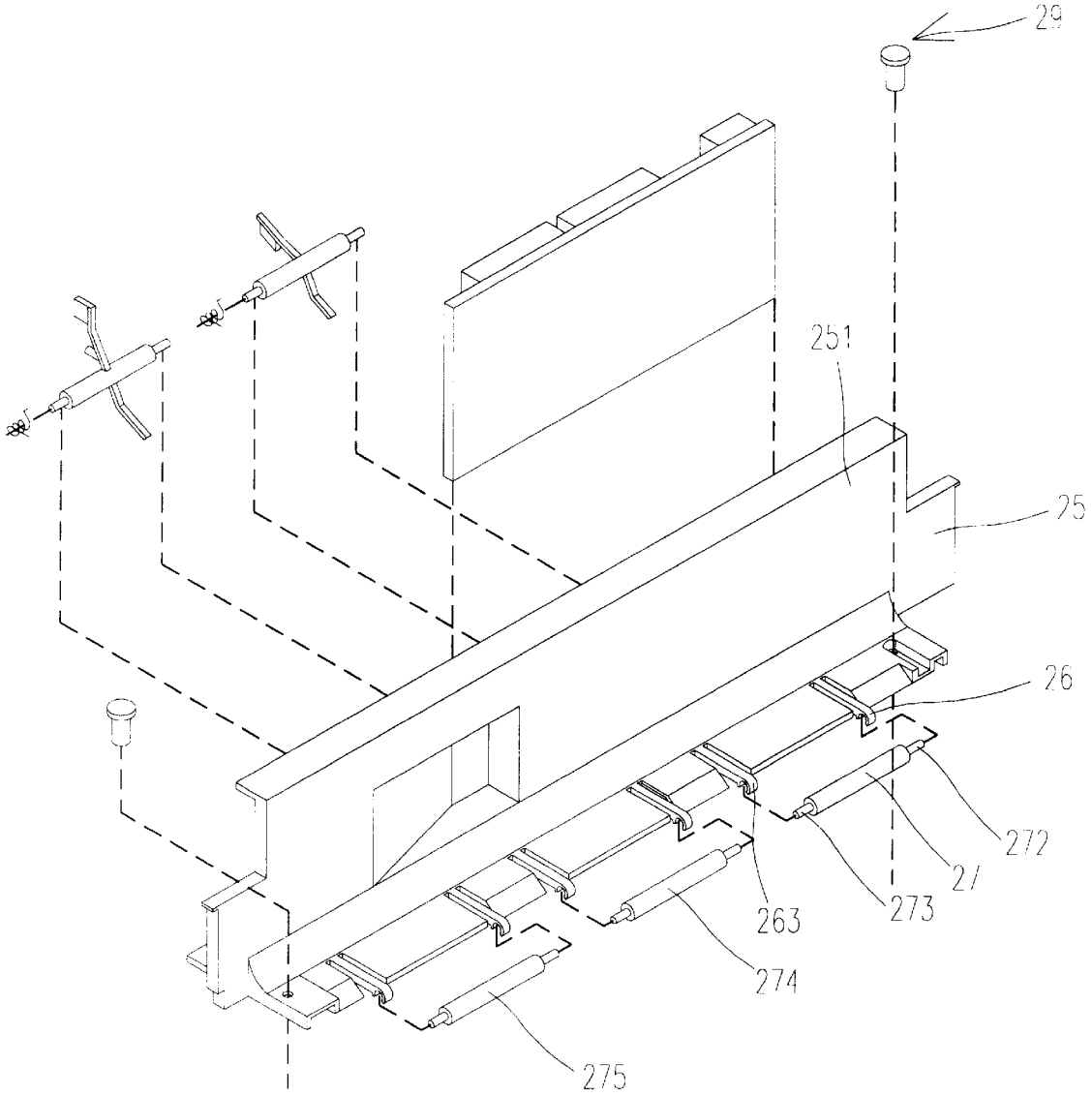
FIG. 3 is an enlarged view of FIG. 2 illustrating the paper guide assembly.

Attention is now directed to FIGS. 2 & 3, in which there is shown a preferred embodiment of a paper guide mechanism 20 for guiding a movement of a paper in a printer. Paper guide mechanism 20 includes a frame body 24 having three lower rollers 21 and mounted in the printer, and a paper guide 25 having three upper rollers 27, 274, 275 cooperating with lower rollers 21 for guiding therebetween the paper, in which upper roller 27 is parallelly displaced with respect to lower roller 21 for biasing the paper in order that the paper can be guided through paper guide 25 smoothly. Paper guide 25 further has an elastic rod 26 being integrally formed with paper guide 25 and the elastic rod is approximately perpendicular to a vertical part 251 of paper guide 25 and retains one end 272 of upper roller 27. Paper guide 25 can further include a second elastic rod 263 for retaining the other end 273 of upper roller 27.

Certainly the paper guide can further include a second upper roller 274 and a third upper roller 275 through which the paper is guided smoothly and the paper guide is screwed to frame body 24 by two screws 29. Upper rollers 27, 274, 275 are following rollers, lower rollers 21 are feeding rollers and there are four delivery rollers 30 mounted on frame body 24.

Figure 4:
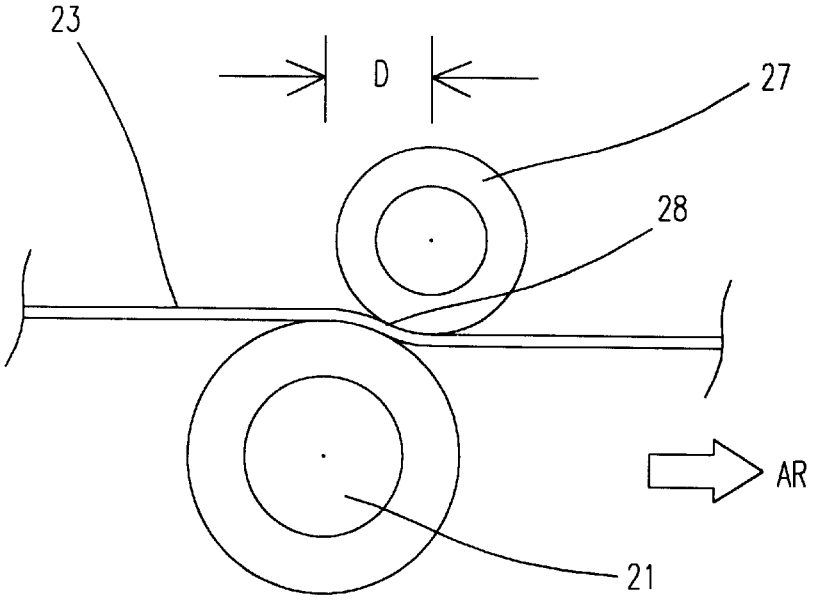
FIG. 4 is a side view showing a paper guided by the upper roller and the lower roller of a paper guide mechanism according to the invention.
Figure 5:
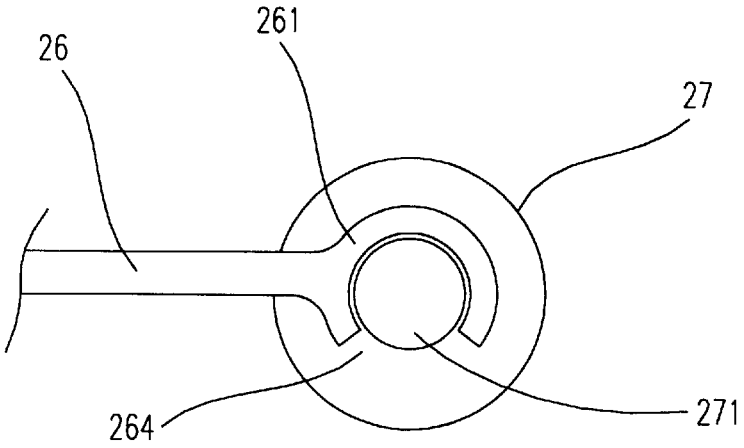
FIG. 5 is a side view showing the combination of the retaining part of the elastic rod of the paper guide and the shaft of the upper roller.

Referring now to FIGS. 4 & 5, there is shown elastic rod 26 having a retaining part 261 to rotatably retain a shaft 271 of upper roller 27. The retaining part can have a retaining channel 261 having an opening 264 through which shaft 271 of upper roller 27 is received in channel 261. The channel can be substantially cylindrical in which shaft 271 of roller 27 is coaxially mounted. Elastic rod 26 can have a higher elasticity as the thickness of paper 23 is thicker. Upper roller 27 and lower roller 21 cooperatively guide the movement of paper 23 along a specific direction AR at a pressed position 28. It can be found that there is a horizontal distance D between the axis of upper roller 27 and that of lower roller 21. The pressed position would be higher as the thickness of paper 23 is thicker and specific derection AR is the direction outputting paper 23 having been printed. The paper's height would be lower as it is guided by upper roller 27 and lower roller 21.

While the invention has been described in terms of what are presently considered to be the most practical and preferred embodiments, it is to be understood that the invention need not be limited to the disclosed embodiments. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What we claim is:

1. A paper guide mechanism for guiding a movement of a paper in a printer comprising:

a frame body mounted in said printer; a lower roller;

a paper guide; an upper roller; wherein said upper roller cooperates with said lower roller for guiding therebetween said paper, said upper roller being parallelly displaced with respect to said lower roller said upper roller being the exclusive cooperating element for biasing and dampening said paper in order that said paper can be guided through said paper guide smoothly; and an elastic rod formed in one piece as one piece with said paper guide for urging said upper roller against said lower roller.

2. A mechanism according to claim 1 wherein said elastic rod comprises a retaining part to rotatably retain a shaft of said upper roller.

3. A mechanism according to claim 2 wherein said retaining part has a retaining channel having an opening through which said shaft of said upper roller is received in said channel.

4. A mechanism according to claim 3 wherein said channel is substantially cylindrical in which said shaft of said roller is coaxially mounted.

5. A mechanism according to claim 1 wherein said elastic rod is approximately perpendicular to a vertical part of said paper guide.

6. A mechanism according to claim 1 wherein said elastic rod retains one end of said upper roller.

7. A mechanism according to claim 6 wherein said paper guide further comprises a second elastic rod for retaining the other end of said upper roller.

8. A mechanism according to claim 6 wherein said paper guide further comprises a second upper roller and a third upper roller through which said paper is guided smoothly.

9. A mechanism according to claim 1 wherein said paper guide is screwed to said frame body.

10. A mechanism according to claim 1 wherein said upper roller is a following roller and said lower roller is a feeding roller.

* * * * *